US006250084B1

(12) United States Patent
Sato et al.

(10) Patent No.: US 6,250,084 B1
(45) Date of Patent: Jun. 26, 2001

(54) SODA DRINK SELLING MACHINE

(75) Inventors: Hiroshi Sato; Hisataka Asami; Makoto Sano; Choiku Yoshikawa, all of Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/429,348

(22) Filed: Oct. 28, 1999

Related U.S. Application Data

(63) Continuation-in-part of application No. 08/988,126, filed on Dec. 10, 1997, now abandoned.

(30) Foreign Application Priority Data

Nov. 19, 1998 (JP) ..... 10-329366

(51) Int. Cl.[7] ..... F25B 21/02

(52) U.S. Cl. ..... 62/3.64; 62/389; 62/390; 62/331

(58) Field of Search ..... 62/389, 390, 331, 62/3.64

(56) References Cited

U.S. PATENT DOCUMENTS 5,003,790 * 4/1991 Goupil ..... 62/389
5,502,978 * 4/1996 Field ..... 62/157
5,511,388 * 4/1996 Taylor et al. ..... 62/389
5,730,863 * 3/1998 Howlings et al. ..... 210/106
5,768,905 * 6/1998 Oh ..... 62/264
5,811,001 * 9/1998 Chang ..... 210/238
5,873,259 * 2/1999 Spillman ..... 62/396
5,956,967 * 9/1999 Kim ..... 62/390
6,101,835 * 8/2000 Butsch et al. ..... 62/390

* cited by examiner

*Primary Examiner*—William Doerrler
*Assistant Examiner*—Mark Shulman
(74) *Attorney, Agent, or Firm*—Crowell & Moring, L.L.P.

(57) ABSTRACT

A soda drink selling machine having a compact purified-water generating unit can be installed at places where purified water suiting for producing soda drinks is not available, comprises a purified-water generating unit, a carbonated water generating unit, a soda drink producing-dispensing unit, and a control system controlling each device in the soda drink selling machine so as to be operated in order or simultaneously at need, wherein the purified-water generating unit comprises a control system for controlling operations in ice maker including a heat transfer surface on heat absorbing side or releasing side of a coolant compression-evaporation type or an electronic heat pump, and in constant temperature purified-water tank, and operations of ice-crystal formation and melting processes in the ice maker.

11 Claims, 8 Drawing Sheets

SODA DRINK SELLING MACHINE

This application is a continuation-in-part of Ser. No. 08/988,126 filed Dec. 10, 1997 abandoned.

BACKGROUND OF THE INVENTION

1. Field of the Invention

This invention relates to a soda drink selling machine for producing soda drinks by dissolving syrup and $CO_2$ gas into water. More specifically, this invention relates to a method of producing soda drinks by purifying local raw water at the site of providing the soda drink, and to a soda drink selling machine with a compact purified-water producing unit, so that the soda drink selling machine is enabled to be installed to places even where purified water suitable for drinks is unavailable.

2. Description of the Related Art

Since it is prerequisite that raw water under sufficient quality control can be obtained as water for a soda drink selling machine, it is hitherto common for a soda drink selling machine to use local raw water as water for dissolving various drinking ingredients. Thus, the conventional soda drink selling machine is not equipped with a water-purifying means.

In a place where purified water suitable for drinks is unavailable, disinfected water with chlorine is usually supplied as the minimum requirements. Raw water supplied under such unfavorable conditions may contain chlorine as described above, various kinds inorganic impurities, and in some cases, organic impurities. In this case, although the chlorinated water may be accepted as an ordinary drinking use, since the chlorine and other impurities may subtly affect the odor and taste as well as the stability of an amount of dissolved $CO_2$ gas, it is not suitable for use in a soda drink selling machine. In case of worse conditions, local raw water is not even drinkable. In such places, in respect to matters of cost and time, it is actually impossible to treat all-purpose local raw water to make suitable enough to be used as purified water in a soda drink selling machine.

Meanwhile, a variety of methods and apparatuses are disclosed as a related art to the present invention. U.S. Pat. No. 5,086,951, discloses "portable post-mix beverage dispenser unit". However, in order to use this art, a source of purified water must be at close range. That is, a portable water tank filled with drinkable water must be equipped to the beverage dispenser, which necessitates the purified-water filled tank to be transported so as to be attached to the beverage dispenser. The beverage dispenser equips a refrigerator but solely for functioning as freeze storage or temperature adjustment of water. Consequently, such a dispenser is unable to be installed or operated in a place of poor raw water quality.

In U.S. Pat. No. 5,124,088, "Process and Apparatus for Rapidly Carbonating Water", a carbonating tank for use in a post-mix beverage dispenser is proposed. The sole feature of the art is that the carbonating tank is a pressure container that maintains a concentration of dissolved $CO_2$ gas in water by injecting $CO_2$ in a restricted manner under pressure. There are no special disclosures of any other features especially as for the restriction or new idea with respect to the quality of raw water. Therefore, such an apparatus is unable to be installed or operated in a place of unsuitable raw water quality.

Further, U.S. Pat. No. 5,353,958 discloses a carbonated beverage dispenser with a constant temperature mixing valve. This carbonated beverage dispenser includes a chiller, an ice maker, and a mixing valve to dissolve carbonic acid at the appropriate temperature so as to increase the concentration of carbonic acid and to maintain the concentration of carbonic acid after dissolution. This art solves a problem relating only to the concentration of carbonic acid and since the art uses municipal water, it does not take measures to cope with raw water of poor quality. Accordingly, this invention is also not suitable for operation at sites where the condition of the raw water is of a poor quality.

Furthermore, U.S. Pat. No. 5,464,124 discloses an apparatus for producing and dispensing post-mix beverage. The art is characterized in that raw water is cooled by utilizing water cooling function of the carbonator tank so as to provide both carbonated drinks and fresh water drinks. There are no special disclosures of any other features especially as for the quality of raw water. Therefore, such an apparatus is unable to be installed or operated in a place of unsuitable raw water quality.

SUMMARY OF THE INVENTION

In the above described related art, the conventional soda drink selling machine does not include any inventions considering problems related to raw water. Therefore, even if all features of the above described art are combined together, it is yet an art upon condition that drinkable or suitable water for producing soda drinks is available at the site where the machine is installed. Therefore, the object of the present invention is to offer a soda drink selling machine which can be installed and operated even at the site where raw water quality is unsuitable.

More specifically, the object of the present invention is to offer a soda drink selling machine having a purified-water generating unit.

A soda drink selling machine which is consistent with the object of the present invention must be a machine which may be easily transported and installed and would be accessed by any unspecified person, all units of a purified-water generating unit, a soda drink producing unit, and a dispensing unit must be preferably provided within the main housing of the machine, or at least attached to the same housing. Also, since the machine must operate automatically, the machine must be equipped with a control system which controls each of the above described units so as to operate the units in a prescribed order, or simultaneously for a prescribed time period.

Therefore, a further object of the present invention is to offer a purified-water generating unit which is suitable for the soda drink selling machine having good transportability. Also, a further object of the present invention is to offer a soda drink producing/dispensing unit suitable for the aforementioned soda drink selling machine as well as a control system which controls each unit of the machine so as to operate the units in a prescribed order or simultaneously for a prescribed time period.

The present invention is a soda drink selling machine which may be installed and operated even in places where the condition of available raw water is of poor quality being characterized by having a purified-water generating unit, a soda drink producing/dispensing unit and a control system within the main housing of the machine, or at least being attached to the same housing. The control system controls the operation of each of the units of the machine so as to operate in a prescribed order or simultaneously for a prescribed time period.

In the meantime, there have been proposed various kinds of methods to purify water. That is, a coagulative precipitation method, an adsorption method, an ion exchange method, an ultrafiltration method, a reverse osmosis method, a distillation method, an electrodialysis method, a crystallization method, and a boiling method. These methods correspond to the quality and degree of content of contaminants in the raw water, as well as the purpose of use of the purified water. Not all of the above described methods are suitable for achieving the object of the present invention in terms of the scale of the process, the special operational conditions, the site of installment, and the quality of the purified water owing to the source of the raw water.

Among said methods, crystallization method is most suitable for a water purifying method in this present invention due to the following reasons: the device may be small enough to be installed in a transportable soda drink selling machine; it is powered by electricity which is conveniently available; the cooling energy generated in the purification process may be used for refrigerating raw materials, intermediates or products in the soda selling machine; the heating energy generated simultaneously in the purification process may be used for heating in the processes of producing soda drinks in the present invention so that both energies can utilize malitiplexly in the same soda selling machine; and stable quality of purified water may be obtained regardless of the condition of the raw water. Thus the present invention is characterized by that raw water is purified by partially crystallizing to form ice-crystal and draining concentrated impurities in the remaining mother liquor.

The purified-water generating unit of the present invention receives raw water in the ice maker to generate ice-crystal by contacting said raw water with the heat transfer surface of the heat absorbing part of the heat pump of a compression-evaporation type or of an electronic type utilizing Peltier effect. After a prescribed fraction of raw water is frozen, the remaining mother liquor is drained leaving the purified ice-crystal. The ice-crystal is then partially melted by contacting with the heat transfer surface of the heat releasing part of the heat pump, and after that, the ice-crystal together with the melted, purified water is led to a constant temperature purified-water tank disposed at the next step. In a case where the heat pump is a compression-evaporation type, said heat transfer surfaces may be reversed by changing a coolant route in the heat pump pipe line circuit. Whereas, in a case where the heat pump is an electronic type, said heat transfer surfaces may be reversed by switching the electric current circuit. Thus a heat transfer surface in the ice maker becomes a heat releasing surface during the ice-crystal melting process and the heat transfer surface becomes a heat absorbing surface during the ice-crystal formation process.

The constant temperature purified-water tank which comprises the purified-water generation unit of the present invention receives unmelted ice-crystal formed in the previous step and is provided with a heat releasing surface in order to melt said received ice-crystal. Further, to maintain a constant water temperature, it is also provided with a heat absorbing surface. In this case, the heat transfer surface may be a part of the heat transfer surface of the heat pump.

In a case where the ice maker of the present invention is in the ice-crystal formation process, one side of the heat transfer surface of the heat pump connected to the unit must release heat. In such a case, it might be necessary to remove heat via a heat transfer surface of a separately installed heat exchanger. Warm water obtained by thus removed heat may be effectively used for adjusting the temperature of water in the fixed temperature purified-water tank. In a case where the ice maker is in the ice-crystal melting process on the contrary, one side of the heat transfer surface of the heat pump connected to the unit must absorb heat. In such a case, it might be necessary to remove the cooling energy via a heat transfer surface of a separately installed heat exchanger. Cold water obtained by thus removed cooling energy is effectively used for adjusting the temperature of water in the fixed temperature purified-water. Further, in this case, a medium for the heat exchanger does not necessarily have to be water.

However there is at least one pair of ice makers in the present invention. Therefore, when one of the ice makers is in the ice-crystal formation process, the one heat transfer surface of the heat pump connected to said ice maker forms ice by contacting raw water to absorb heat, while another heat transfer surface must release heat. Therefore in the present invention, said heat releasing heat transfer surface is constructed to become a heat transfer surface in the ice-crystal melting process of another ice maker of this pair.

In case of a compression-evaporation type heat pump, released heat surpasses the absorbed heat with regard to the absorbing-releasing balance of heat so that it is necessary to remove heat by connecting an additional condenser or heat exchanger in addition to exchanging heat between the pair of ice makers. The removed heat may be effectively used to adjust the temperature of purified water.

In case the heat pump connected to the ice maker of the present invention is a Peltier thermo-module, one surface of the module plate absorbs heat, while the other surface releases heat. This heat pump is constructed so that the heat absorbing and releasing surfaces reverse each other by inverting the electric current polarity. When one of the heat transfer surfaces is included in an ice maker, and the other heat transfer surface is exposed to the outside of the ice maker to release or absorb heat, the other heat transfer surface is so constructed as to be a radiator with a large surface area to release or absorb heat by convection or forcibly with a fan.

However, the construction that one of the heat transfer surfaces is included in one ice maker while the other heat transfer surface is included in the other ice maker so that a pair of ice makers shares one Peltier thermo-module is most preferable in the present invention. That is, the above described construction is the most suitable for the purified-water generating unit of the present invention and realizes an effective use of energy because it is necessary to operate an ice-crystal formation and melting process alternatively. Furthermore several ice makers may be connected in series intervened by a Peltier thermo-module so as to increase the capacity of the purified-water generating unit compactly, which makes the machine suitable for transportation.

Meanwhile, in the process of ice-crystal formation of the ice maker, to make a high purity ice-crystal, it is necessary to promote flowage of raw water on the ice surface. For this reason, another characteristic of the present invention is that the ice makers are equipped with a flowage aid, and a bubbling means is a convenient option. Although air bubbling is common, according to the case, it can be $CO_2$ bubbling which serves as a part of the soda drink producing process.

Although a constant temperature purified-water tank for storing purified water at constant temperature is equipped as basic structure of the purified-water generating unit of the present invention, said tank may be omitted and the ice maker may be used as purified-water tank as well by programming the sequential steps of said processes appropriately.

Next, in a soda drink selling machine of the present invention, purified water obtained from the purified-water generating unit is led to the soda drink producing-dispensing unit of the next step. This unit comprises a $CO_2$ gas dissolving means, a syrup mixing means, and a soda drink dispensing means.

A $CO_2$ gas dissolving means receives the purified water generated by the previous process in the purified-water generating unit, and dissolves $CO_2$ gas in the purified water to make a prescribed concentration of carbonated water, and maintains the temperature of the carbonated water. The $CO_2$ gas dissolving unit comprises a pressure container equipped with a $CO_2$ gas bubbling nozzle, a gas bomb equipped with a pressure reducing valve, flow control valves, and connecting piping. The pressure container includes a cooling means such as a jacket, a heat transfer coil, or one of heat transfer surfaces of a Peltier thermo-module. Further, the pressure container is pressure resistingly constructed so as to sustain $CO_2$ gas pressure for increasing gas dissolving rate, obtaining prescribed concentration of the $CO_2$ gas dissolved in the purified water, and maintaining its concentration.

Whenever necessary, the carbonated water containing a prescribed concentration of dissolved $CO_2$ gas at a suitable temperature is lead to a syrup mixing means. The syrup mixing means is constructed of a syrup container, a means for transferring a fixed amount of carbonated water, a means for transferring a fixed amount of syrup, a mixing means, and connecting piping. The mixing means is an agitating pipe because of its small size and its reliability, so that carbonated water and syrup are mixed during transferring in the pipe to the dispenser or the soda drink dispensing unit of the last step.

A constant temperature purified-water tank of the purified-water generating unit serves concurrently as the pressure container of the $CO_2$ gas dissolving means. However, in this case, the constant temperature purified-water tank should be a pressure resistant container of sealed structure, and purified water received from the ice maker must completely be melted. In addition, an ice maker tank in the purified-water generating unit serves concurrently as the pressure container of the $CO_2$ gas dissolving means.

Figure 1:
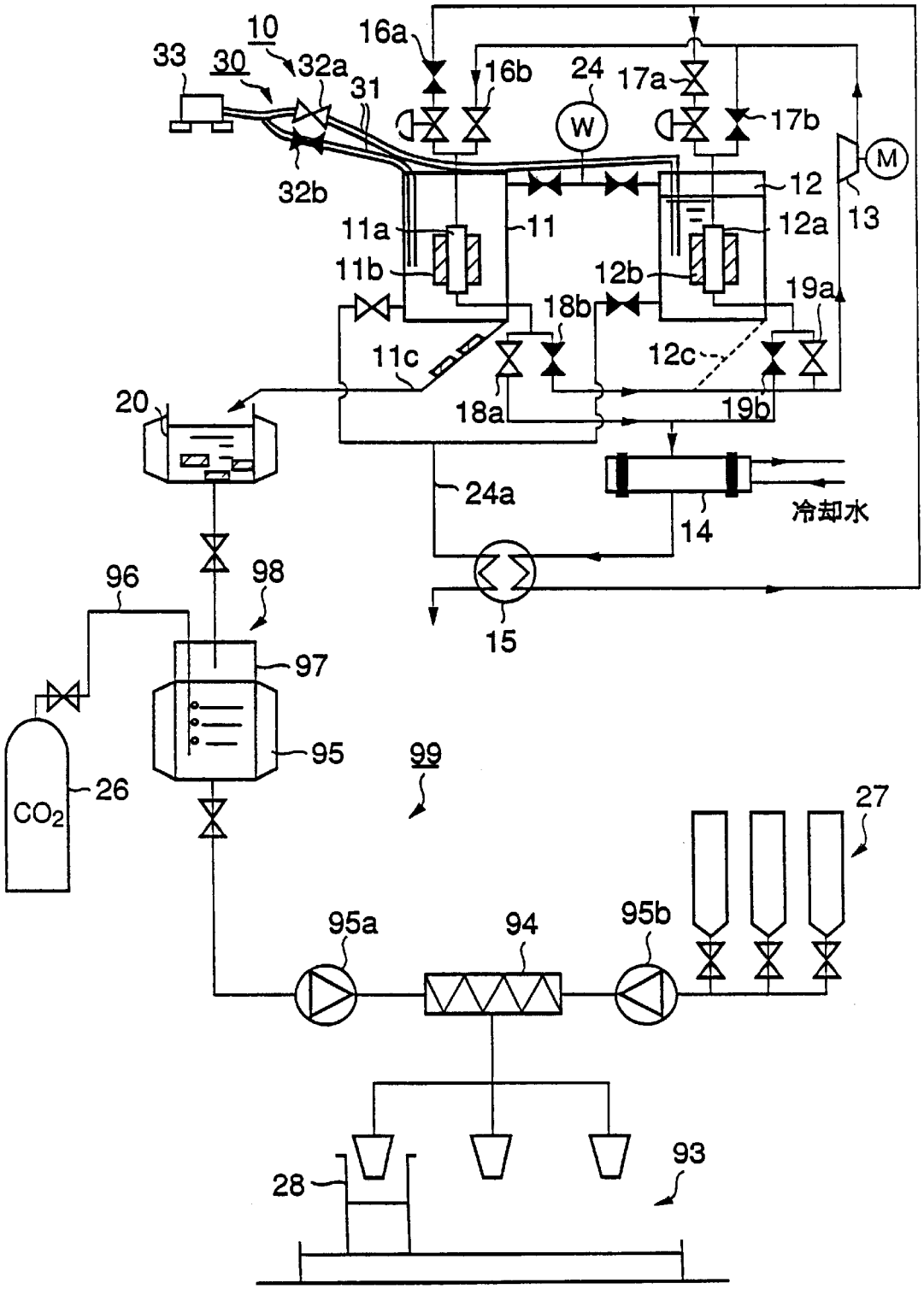
FIG. 1 is a schematic diagram showing the construction of a soda drink selling machine having a purified-water generating unit of the present invention.

In the drawings described above, reference numeral 10 represents purified-water generating unit, 11 and 12 ice makers, 13 compressor, 14 condenser, 15 heat exchanger, 21 constant temperature purified-water tank, 24 raw water source, 25 soda drink producing/dispensing unit, 26 $CO_2$ gas bomb, 27 syrup container, 28 cup, 30 air-bubbling device, 31 air bubbling nozzle, 32 air bubbles, 33 air pump, 35 heat transfer plate, 36 heat transfer filler, 37 thermo-module plate, 38, 51 and 51*a* DC power supplies, 50 Peltier thermo-module, 52 raw-water tank, 53 purified-water tank, 54 Peltier element, 55 ice making reservoir, 56 cold-water jacket, 57 air cooling device, 93 dispensing unit, 94 agitator pipe, 95*a*, 95*b* flow control valve, 96 $CO_2$ gas bubbling nozzle, 97 pressure container, 98 $CO_2$ gas dissolving means, 99 soda drink producing/dispensing unit.

DETAILED DESCRIPTION OF THE PREFERRED EMBODIMENTS

The invention will now be described in detail in conjunction with embodiments illustrated in the drawings. Unless particularly specified, the sizes, materials, shapes, relative positions and etc. of parts described in the embodiments have no sense of limiting the scope of the invention, but are merely exemplary.

Figure 2:
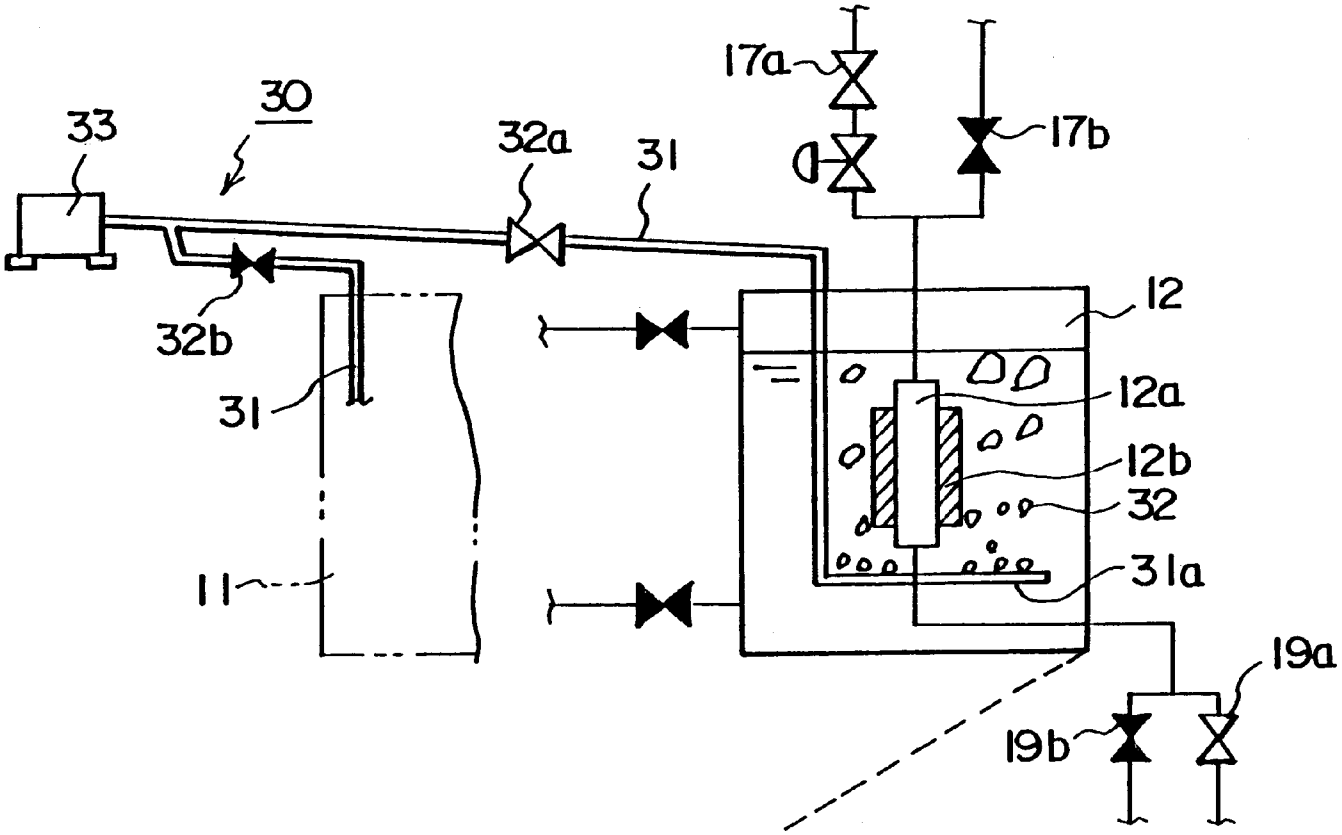
FIG. 2 is a view showing the operation of an air-bubbling device 30 disposed on an ice maker shown in FIG. 1, as a fluidizing means for promoting effective ice-crystal formation.
Figure 3:
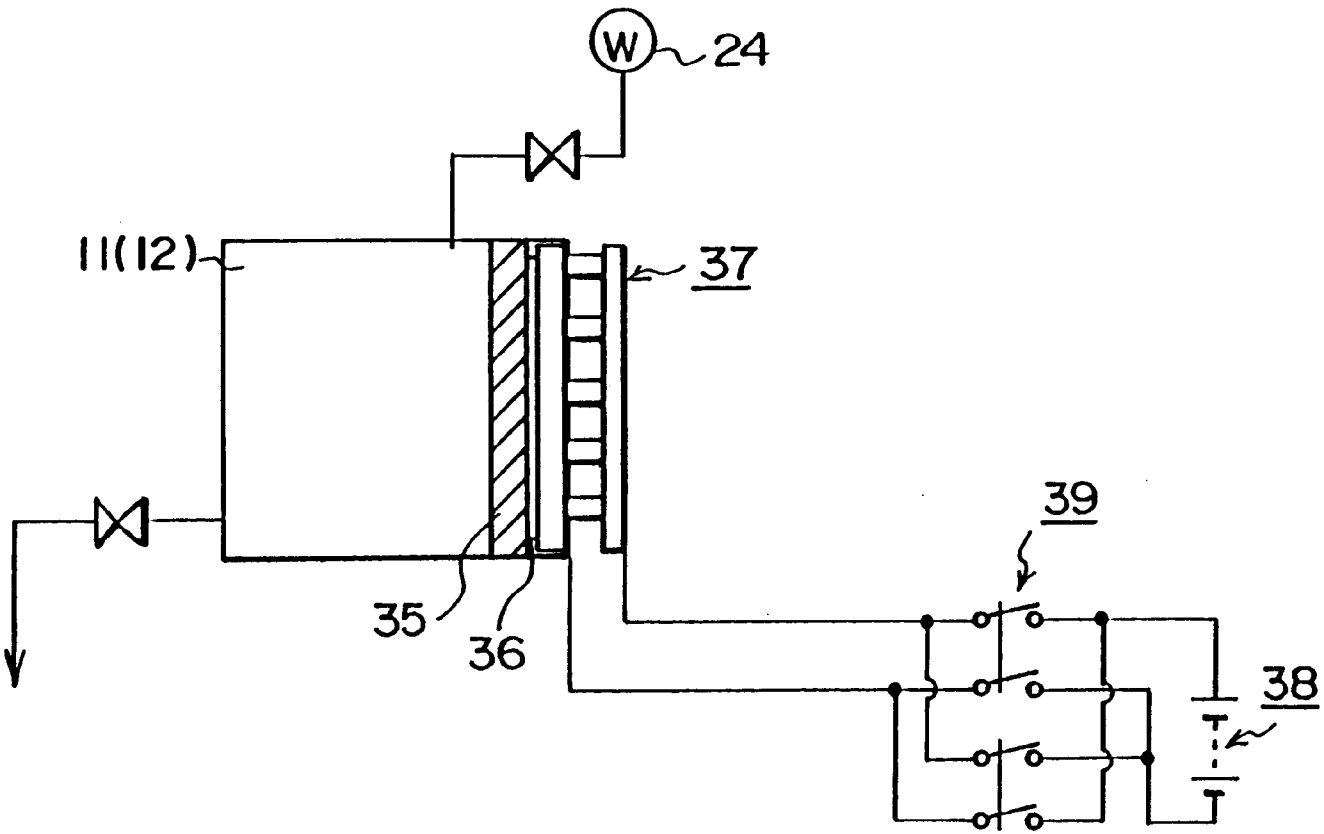
FIG. 3 is a view showing an ice maker based on an electronic heat pump utilizing absorbed or generated heat due to Peltier effect, the electronic heat pump being disposed in the ice maker in place of the heat pump shown in FIG. 1 including coolant pipes, a compressor, a condenser and a heat exchanger.
Figure 5:
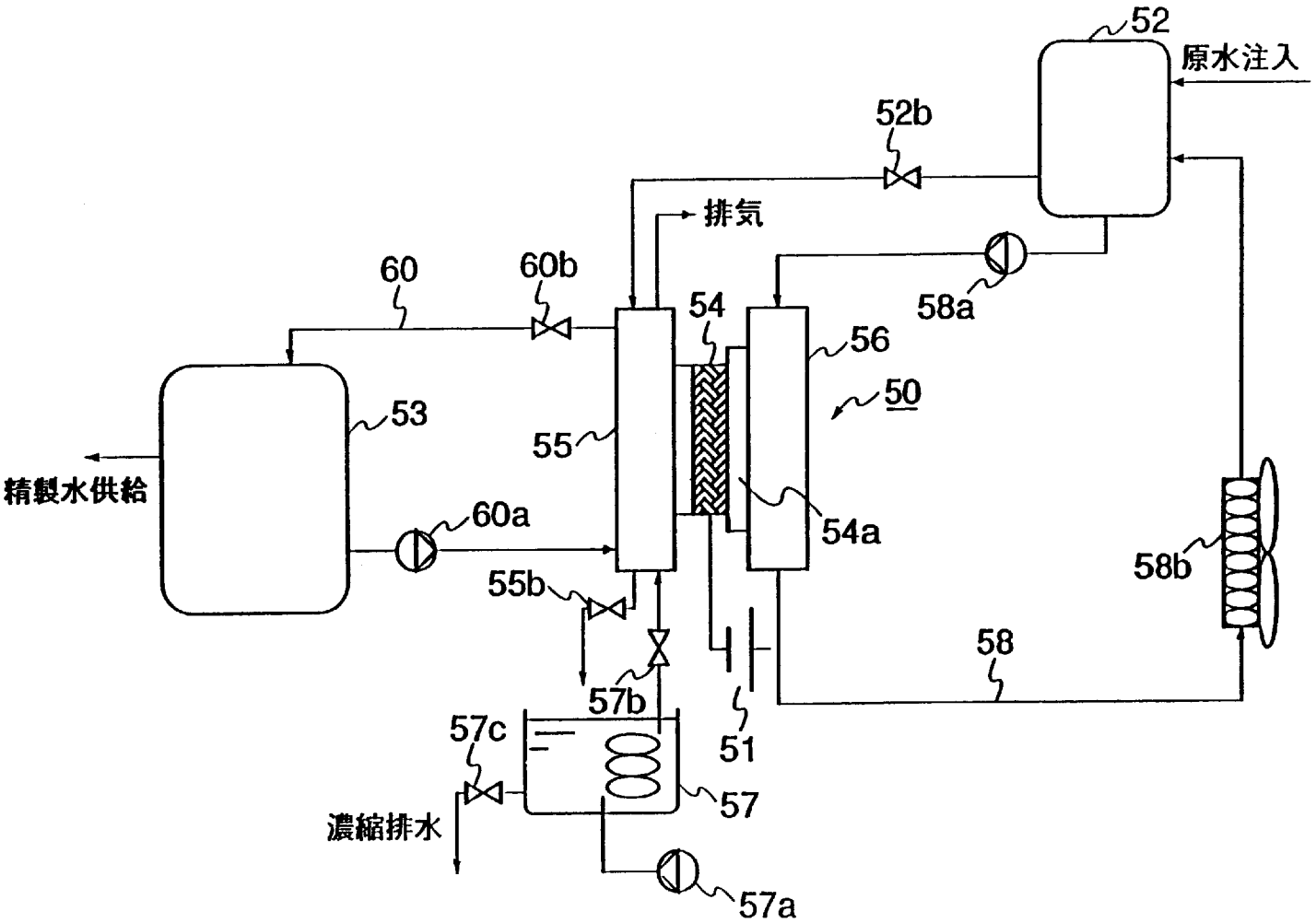
FIG. 5 is a schematic diagram showing the construction of an electronic purified-water generating unit that generates purified water by using a heat pump with a pair of Peltier thermo-modules, in place of the purified-water generating unit shown in FIG. 1.

FIG. 1 is a schematic diagram showing the construction of a soda drink selling machine using a purified-water generating unit of the present invention, and FIG. 2 is a view showing the operation of an air bubbling device 30 disposed on an ice maker shown in FIG. 1, as a means for promoting effective ice-crystal formation by air bubbling. FIG. 3 is a view showing an ice maker based on an electronic heat pump utilizing absorbed or generated heat due to Peltier effect, the electronic heat pump being provided in the ice maker in place of the heat pump shown in FIG. 1 including coolant pipes, a compressor, a condenser and a heat exchanger. FIG. 5 is a schematic diagram showing the construction of an electronic type purified-water generating unit that generates purified water by using a heat pump with a pair of Peltier thermo-modules, in place of the purified-water generating unit shown in FIG. 1.

As shown in FIG. 1, a soda drink selling machine of the present invention comprises a purified-water generating unit 10 and a soda drink producing/dispensing unit 25. The purified-water generating unit 10 is composed of ice makers 11 and 12, a constant temperature purified-water tank 21, raw water source 24, coolant pipes 11*a* and 12*a* disposed in the ice makers, a heat pump comprising a compressor 13, a condenser 14 and a heat exchanger 15, and an air-bubbling device 30 as a means for promoting ice-crystal formation.

As described above, the heat pump forms a compression-evaporation type freezing cycle with coolant pipes 11*a* and 12*a* in the ice makers 11 and 12, a heat exchanger 15, a condenser 14 and a compressor 13. It can cool or heat, that is, exchange heat by connecting the upper ends of coolant pipes 11*a* and 12*a* through valves 16*a* and 17*a* to the condenser 14 via the heat exchanger 15, or through the valve 16*b*, 17*b* to the high temperature, high pressure discharge side of the compressor 13. The lower ends of coolant pipes 11*a* and 12*a* are connected to a suction side of the condenser 14 and to a low pressure suction side of the compressor 13 via valves 18*a* and 19*a*, and forms a freezing cycle by means of the above described valves 16*a*, 17*a* and 16*b*, 17*b*. In the drawings, closed valves are shown in black, and open valves are shown in white.

That is, the high pressure, high temperature coolant is led from compressor 13 to either one of the coolant pipes 11*a* and 12*a* to give the heat. Then, said coolant is led to condenser 14 to be condensed with cooling water. The condensed coolant is led to the other one of the coolant pipes 11*a* and 12*a* via heat exchanger 15 to be evaporated so as to give cooling energy before being returned to the low pressure suction side of the compressor 13.

The state of operations of the soda drink selling machine will now be described with reference to the accompanying drawings. The machine shown in the illustration is in operation of an ice-crystal melting process, wherein a prescribed fraction of the raw water received in the ice maker is crystallized to form an ice-crystal 11*b* on the surface of coolant pipe 11*a* of the ice maker 11 during the ice-crystal forming process, then, cold waste water consisting of remaining raw water in the ice maker and water used to have washed the surface of ice-crystal 11*b* is drained outside by pipe 24*a* through heat exchanger 15, thereafter, ice-crystal 11*b* is heated by the releasing heat of the high temperature/high pressure coolant gas which is discharged from the high pressure discharge side of the compressor 13, so that the ice-crystal 11*b* starts to leave the coolant pipe 11*a*. Detached ice-crystal pieces as described above fall by its own weight to the constant temperature purified-water tank via chute 11*c* and said ice-crystals are further melted by a constant temperature device to store as purified water in the tank. In case the tank temperature tends to rise higher than the prescribed temperature due to an environmental temperature, the constant temperature device operates to cool down the melted water.

In the illustrated state, ice maker 12 is full of raw water supplied from the raw water source 24. The high pressure, high temperature gas that has detached the ice-crystal formed on the coolant pipe 11*a* is led through valve 18*a* to the condenser 14 to be cooled and condensed by cooling water of the condenser. Then, the cooled and condensed gas is led to the heat exchanger 15 to be further cooled by the aforementioned cold waste water and forms a condensed coolant. The condensed coolant is led through the valve 17*a* and evaporated in the coolant pipe 12*a* of the ice maker 12 to give cooling energy so as to freeze the surrounding raw water. Thus, as described above, purified water is finally obtained by using a pair of ice makers in alternate processes of ice-crystal formation and ice-crystal melting.

FIG. 2 illustrates the operational state of the air bubbling device 30 disposed as a fluidizing means for promoting pure ice-crystal formation. The air bubbling device 30 has an air pump 33, valves 32*a* and 32*b*, and air blowing pipes 31. As shown in FIG. 2, air is blown into the ice maker 12 via the valve 32*a* and into the ice maker 11 via the valve 32*b*. Each of the immersed tip parts of air bubbling nozzles 31 has a plurality of small air bubbling holes 31*a*. The raw water in the state of turning in to ice-crystals in each ice maker is stirred and given flowability of upward, downward, leftward and rightward directions by means of many air bubbles 32 blown out through holes 31*a*. Consequently, fresh raw water is re-circulated around the coolant pipe at all times, and promotes a high-purity ice-crystal formation. It is also possible to resort to a stirring and circulating action of a stirrer as said fluidizing means.

Subsequently, valves 16*b*, 17*a*, 18*a*, and 19*a* having been open are closed, and valves 16*a*, 17*b*, 18*b* and 19*b* having been closed are opened. In this state, ice-crystal 11*b* is formed in the ice maker 11, while ice-crystal 12*b* is melted in the ice maker 12, and ice-crystal pieces and purified water are led along the chute 12*c* to be sent to the constant temperature purified-water tank 20.

Also, the heat exchanger 15 alternatively receives from the ice makers 11 and 12 cold waste water consisting of washing water and residual mother liquor, which gives the cooling energy to the condensed coolant. Thus the electric power consumption of the heat pump including the ice maker 11 and 12, compressor 13, and condenser 14 is reduced.

The $CO_2$ gas dissolving means 98 of the soda drink producing/dispensing unit 99, includes a pressure container 97, a $CO_2$ gas bubbling nozzle 96 and a constant temperature means 95, and receives a prescribed amount of purified water from the constant temperature purified-water tank 20. Then, the $CO_2$ gas provided from the $CO_2$ gas bomb 26 is blown into the purified water to be dissolved. When the pressure of the gas in the pressure container becomes stable at a prescribed pressure, the $CO_2$ dissolving process is completed.

In the soda drink producing-dispensing unit 99 of the soda drink selling machine 25, the flow control valves 95*a* and 95*b* start operation by a signal denoting a demand. The control valves conduct a prescribed amount of carbonated water and syrup from the syrup container 27 and the $CO_2$ dissolving means 98 to the agitator pipe 94. In the agitator pipe 94, carbonated water and syrup are mixed together, and after the mixing is completed, the dispensing means 93 pours the soda drink to a cup 28 on the dispensing station.

FIG. 3 shows a heat pump based on an electronic freezing process utilizing absorbed or generated heat by Peltier effect, and the heat pump is provided on the ice maker, and replaces the compression/evaporation type heat pump including a heat transfer surface for forming and melting ice-crystal. As shown in FIG. 3, the heat pump based on the electronic freezing process has a DC power supply 38 having a switch 39, which changes the polarity of electricity for driving a thermo-module plate 37. The thermo-module plate 37 is fixed to a heat transfer plate 35 in each of the ice makers 11, 12 with heat transfer filler 36 made of heat conductor resin.

In order to change the ice-crystal formation process to the ice-crystal melting processor vice versa, the heat absorbing side (cooling surface) and the heat generating side (heat release surface) of the same heat transfer surface operates alternately by switching the polarity of the DC power supply 38 for driving the thermo-module plate 37.

Figure 4:
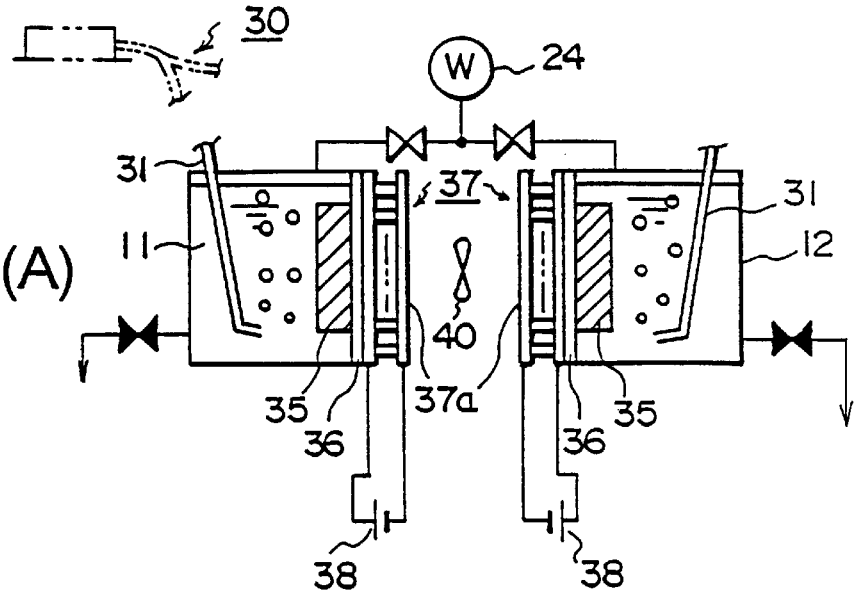
FIGS. 4(A) and 4(B) show the heat pump having the construction of FIG. 3 mounted in a purified-water generating unit shown in FIG. 1, FIG. 4(A) showing a state when ice makers 11 and 12 are both forming ice-crystal, FIG. 4(B) showing a state where ice maker 11 is separating ice-crystal while ice maker 12 is forming ice-crystal.
Figure 4:
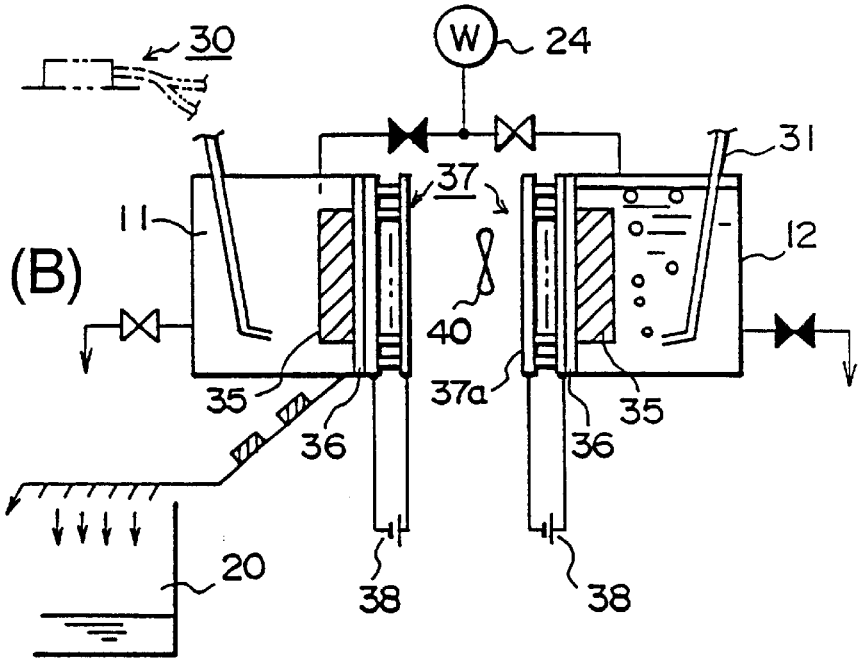

FIGS. 4 shows the state of the heat pump with the above described construction equipped in the purified-water generating unit shown in FIG. 1. FIG. 4(A) shows a case in which both of the two ice makers 11 and 12 are simultaneously forming ice-crystal. The two thermo-module plates 37 and 38 in the two ice makers 11 and 12 are connected to the DC power supply so as to flow the electric current of the same direction so that the heat transfer surfaces of the both thermo-modules become heat absorbing surfaces, each being contained in the each ice maker. In this case, both of the two heat release surfaces 37*a,* 37*a* of the thermo-modules are cooled by a cooling fan 40. FIG. 4(B) shows a case in which the ice maker 11 is in the ice-crystal melting process while the other ice maker 12 is in the ice-crystal forming process. The heat transfer surface 35 of the thermo-module plate 37 becomes a heat release surface in the ice maker 11 while the heat transfer surface 35 of the thermo-module plate 37 becomes a heat absorbing surface in the ice maker 12. In this case, the heat release surface 37*a* of the thermo-module plate 37 provided on the side of the ice maker 12 is cooled by the fan 40. As shown in FIGS. 4(A) and (B), during ice-crystal formation, ice-crystal is formed in the full water state with water supplied from the raw water source 24, the air bubbling device 30 being held operative.

FIG. 5 is a schematic illustration showing a soda drink selling machine equipped with an electronic type purified-water generating unit having a heat pump with a pair of Peltier thermo-modules, in place of the heat pump of the purified-water generating unit shown in FIG. 1. As shown in the figure, the electronic type purified-water generating unit is comprising a pair of Peltier thermo-modules 50, a DC power supply of reversible polarities 51, a raw water tank 52 and a purified-water tank 53. Said Peltier thermo-module 50 has a single structure comprising Peltier element 54 on both sides of which ice making reservoir 55 and cold-water jacket are disposed. A air cooler 57 is disposed under the ice making reservoir 55 to utilize the waste cooling energy of residual mother liquor remained after ice forming process drained from the ice making reservoir 55 via valve 55*b*. During ice-crystal formation, the air cooled by the air cooler 57 is sent to the ice making reservoir 55 with air pump 57*a* and valve 57*b* so as to utilize the generated cooling energy effectively. The residual mother liquor is drained out through valve 57*c* after the ice-crystal formation process. The element surface 54*a* of the Peltier element 54 which becomes a heat releasing surface when ice forming process and a heat absorbing surface when ice melting process is attached to the heat transfer surface of the cold-water jacket 56 to form one structure. A raw-water circulating path 58 is formed to circulate raw water from the raw-water tank 52 with raw-water circulate pump 58*a* in both processes of ice-crystal formation and ice-crystal melting. Thus the heat release surface on the Peltier element 54*a* is cooled by the raw water during ice-crystal formation and the heat absorb surface on the Peltier element 54*a* precools raw water during ice-crystal melting. Further, raw water having been heated at the cold-water jacket 56 is cooled down by the cooling tower 58*b* disposed in the raw-water circulate path 58 when ice-crystal formation. Also, raw water having been pre-cooled in the ice-crystal melting process is supplied to the ice making reservoir 55 via 52*b* from the raw water tank 52 before starting ice-crystal formation process. The purified-water circulating path 60 is formed by connecting the purified-water to ice making reservoir 55 via purified-water circulate pump 60*a* and a valve 60*b*. The ice produced in the ice forming process is melted by circulating purified water through valve 60*b* with the purified-water circulate pump 60*a* during ice-crystal melting process.

The structure as described above is thus capable of providing purified water from raw water by repeating alternately forming and melting processes of ice-crystal using Peltier element 54. Moreover, since precooling of raw water is done by cold-water jacket 56 that is contacting with the heat absorbing surface of the element 54*a* during ice-crystal melting, the precooling can be done in the ice-crystal melting process with high coefficient of performance and the coefficient of performance in the ice-crystal formation process can be simultaneously risen so as to improve thermal efficiency within the total system. Furthermore, there is no need for complicated mode switching operation since this embodiment utilizes cooling process by the cold-water jacket at the heat releasing side and the raw-water circulate path having a raw-water tank and a raw-water pump. Moreover, the residual mother liquor of about 0 after ice forming process is used for cooling air for bubbling and then drained out of this system, which also contributes to improve the thermal efficiency of the system. Also, when the Peltier thermo-module is used in a soda drink selling machine of the present invention, machinery having moving parts, compressors, condensers, and other peripheral equipment as such are unnecessary so that the system surpasses especially in the cost for installment and maintenance.

Figure 6:
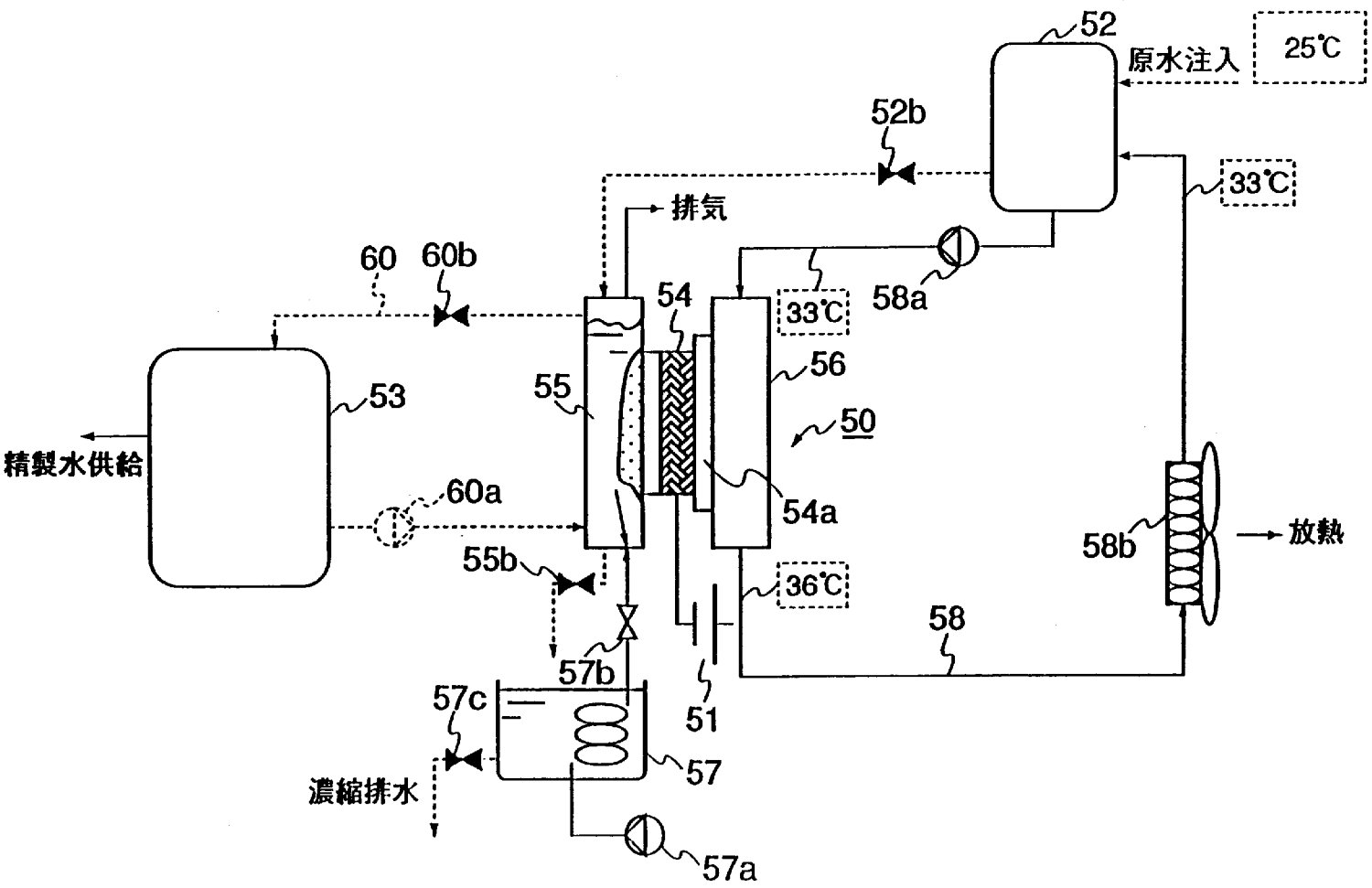
FIG. 6 is a view showing the operations of each of the components of the electronic purified-water generating unit under the process of forming ice-crystal/heat release, as shown in FIG. 5.

According to FIG. 6, operating state of each components during ice-crystal formation/melting processes in the purified-water generating unit by using the Peltier thermo-module type heat pump as shown in FIG. 5 is explained as follows. (1) Raw water, which has been precooled to about 4° C. during ice-crystal melting process, enters into the ice making reservoir 55 via valve 52*b,* and then the DC power supply 51 for ice-crystal formation/melting processes is turned on. (2) Simultaneously, air, which has been cooled by drained mother liquor in air cooler 57, is led to the ice making reservoir 55 by the air pump 57 via valve 57*b* to form highly pure ice-crystal by bubbling on ice surface. (3) At same time, raw water is circulated into the cold-water jacket 56 from raw-water tank 52 through raw-water circulate path 58 with raw-water circulate pump 58*a,* so as to cool the surface of the element 54*a* of the heat release surface of the Peltier element 54. In this state, raw water of about 25 is elevated to about 36 in temperature at the cold-water jacket 56. When the temperature of raw water is reached the temperature of outside air, the cooling tower 58*b* on the raw-water circulating path 58 starts releasing heat and so cools the raw water down to about 33° C. and then the raw water returns to the raw-water tank 52. (4) Subsequently, ice-crystal formation is stopped at time when thickness of ice-crystal reaches setting value by detecting temperature of heat absorbing surface of the Peltier element 54. Residual mother liquor in the ice making reservoir 55 is drained to the air cooler 57 via 55*b* and is used for cooling bubbling air in the next ice-crystal formation process.

Figure 7:
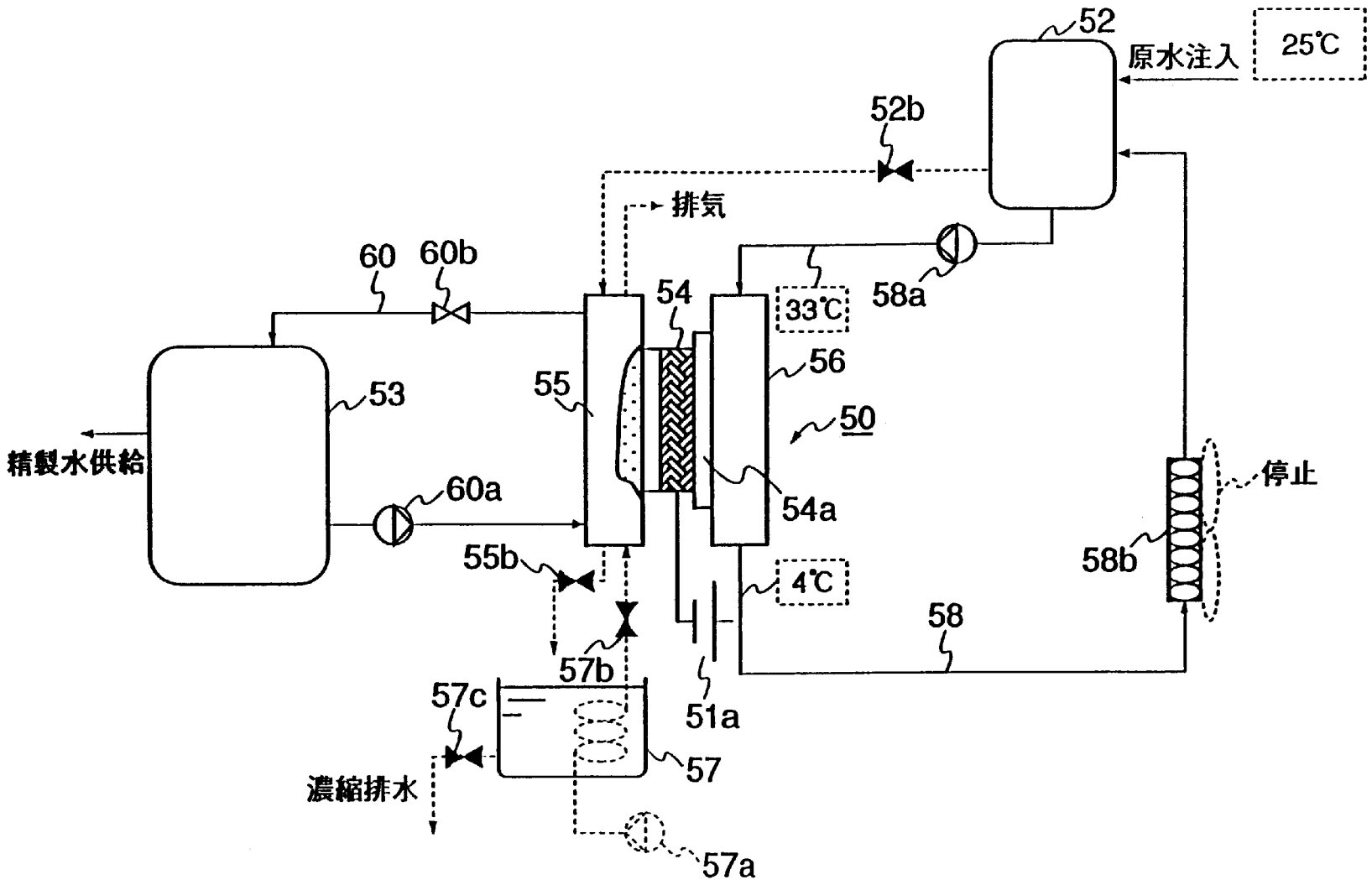
FIG. 7 is a view showing the operations of each of the components of the electronic purified-water generating unit under the process of melting ice-crystal/cooling raw water, as shown in FIG. 5.

According to FIG. 7, operating state of each components, during ice-crystal melting/raw-water cooling processes in the purified-water generating unit by using the Peltier thermo-module type heat pump as shown in FIG. 5, is explained as follows. (1) DC power supply 51*a* for ice-crystal melting/raw-water cooling processes is turned on so as to reverse polarities of the ice-crystal formation/melting processes. (2) By turning on the DC power supply, heat release surface is formed in the ice making reservoir 55, and ice-crystal, which have been generated in the ice-crystal formation process, is separated by circulating purified water from purified-water tank 53 through purified-water circulating path 60, purified-water circulating pump 60*a* and valve 60*b*. (3) Simultaneously, in cold-water jacket 56, which is contacting to surface of element 54*a* formed as heat absorb surface, raw water is made to circulate through raw-water circulate path 58 and raw-water circulate pump 58*a* and so that raw water in raw-water tank is precooled. In this state, temperature of raw water in raw-water tank after ice-crystal formation process, having been about 33° C. is cooled down to about 4° C. (4) Neither of cooling tower 58*b* nor air cooler 57 is operated. (5) Detecting completion of ice-crystal melting by temperature of circulating purified-water, ice-crystal melting/raw-water cooling processes are finished. (6) After purified water in ice making reservoir 55 is received to purified-water tank, precooled raw water of 4 is supplied from raw-water tank 52 to the ice making reservoir 55 via valve 52*b*.

Figure 8:
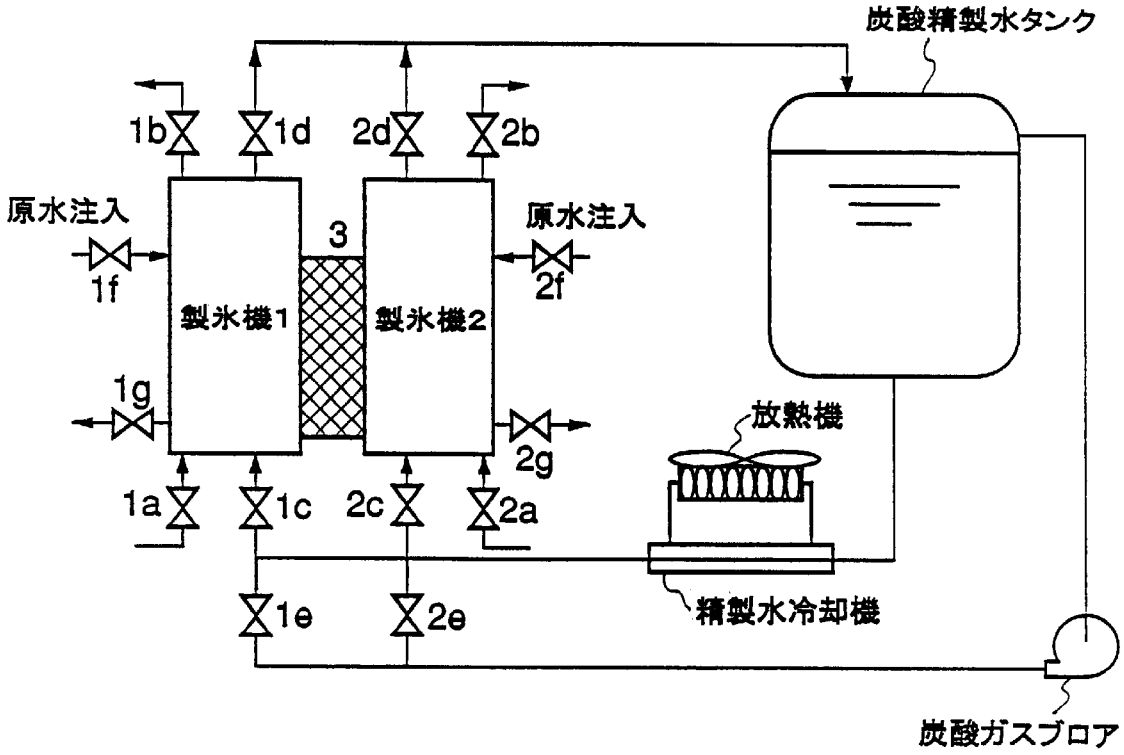
FIG. 8 is a schematic diagram showing another embodiment of the present invention utilizing a Peltier thermo-module type heat pump.

FIG. 8 shows another embodiment of the present invention using Peltier thermo-module type heat pump. This embodiment is an example of $CO_2$ gas dissolving process being done directly inside of the ice maker, and is explained based on the sequence program of this embodiment referring to the following drawings. At first, one side of heat transfer surfaces of the Peltier module plate 3 is disposed in the ice maker 1 and another side of heat transfer surfaces of the same Peltier module plate 3 is disposed in the ice maker 2. The system is electrically connected so as to make both heat transfer surfaces to generate and absorb heat by changing polarities of DC power supply.

The sequential steps of the embodiment are described in the following while 1*a*~2*g* are valves which open and close each connecting pipe.

A case of the ice maker 1 entering into the ice making process.

(1) Open if to receive raw water. Close after raw water is received. (2) Start ice-crystal formation by turning on the power of the Peltier thermo-module. (3) Open 1*a*, 1*b* to start air bubbling. (4) Turn off the power of the Peltier thermo-module, finish ice-crystal formation by closing la. (5) Open 1*g* to drain the residual mother liquor. Close after the residual mother liquor is drained. (6) Open 1*c* to receive purified water. Close after purified water is received. (7) Start ice-crystal melting by turning on the power of Peltier thermo-module by reverse polarity. (8) Open 1*e*, 1*d* to start $CO_2$ gas bubbling. (9) Turn off the power of Peltier Thermo-module, and finish ice-crystal melting by closing 1*e*. (10) Remove purified water. Close 1*c*, 1*d* after removal of purified water. (11) Receive raw water.

A case of the ice maker 2 entering into the ice melting process.

(1) Open 2*c* to receive purified water. Close after purified water is received. (2) Start ice-crystal formation by turning on power of Peltier thermo-module. (3) Open 2*e*, 2*d* to start $CO_2$ gas bubbling. (4) Turn off the power of Peltier thermo-module, finish ice-crystal melting by closing 2*e*. (5) Remove purified water. Close 2*c*, 2*d* after removal of purified water. (6) Open 2*f* to receive raw water. Close after raw water is received. (7) Start ice-crystal formation by turning on the power of Peltier thermo-module by reverse polarity. (8) Open 2*a*, 2*b* to start air bubbling. (9) Turn off the power of Peltier thermo-module, finish ice-crystal formation by closing 2*a*. (10) Open 2*g* to drain concentrated water. Close after concentrated water is drained. (11) Receive purified water.

According to this embodiment, ice-crystal formation and ice-crystal melting are performed simultaneously at both sides of heat transfer surfaces of the Peltier thermo-module, and each step of both ice makers is controlled to be performed synchronously in sequence.

Figure 9:
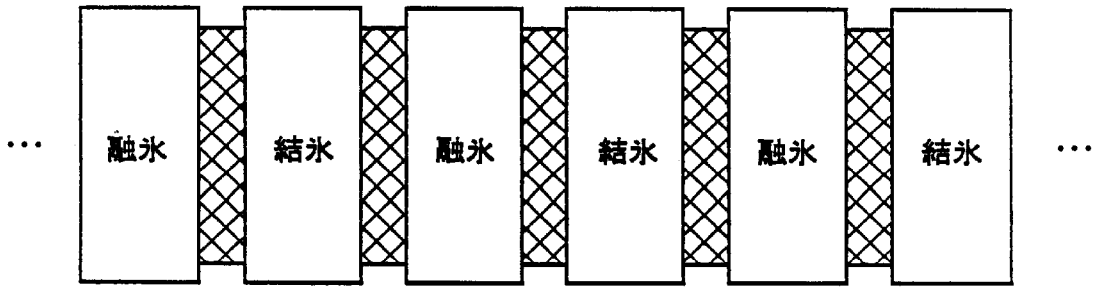
FIG. 9 is a conceptual view showing an example of connecting several ice makers intervened by Peltier thermo-modules.

FIG. 9 shows an embodiment wherein several ice makers are continuously connected via Peltier thermo-module, and is most suitable for transportation of the selling machine because capacity of the system can compactly be extended.

According to the structure of the present invention as described above, a soda drink selling machine may be installed in a wide-range without being affected by the quality of supplied raw water.

What is claimed is:

1. A soda drink selling machine in which an extensive range of quality of raw water is used, comprising:

a purified-water generating unit;

a soda drink producing/dispensing unit; and a control system for controlling each unit of the soda drink selling machine so as to be operated in a prescribed order or simultaneously;

wherein the purified-water generating unit comprises an ice maker having a heat transfer surface of heat absorbing part or a heat transfer surface of heat releasing part which belongs to a compression/evaporation type of heat pump or an electronic type of heat pump and a constant temperature purified-water tank and a control system for controlling operations of the ice maker so as to operate alternately the ice forming process and the ice melting process.

2. The soda drink selling machine according to claim 1, wherein an ice maker is constructed so as to serve as a constant temperature purified-water tank.

3. The soda drink selling machine according to claim 1 or 2, wherein at least one pair of ice makers is constructed so that when one of the ice makers is in the ice-crystal formation process, the other is in the ice-crystal melting process.

4. The soda drink selling machine according to claim 1 or 2, wherein the ice maker have a heat transfer surface of a heat pump which contacts the raw water directly or indirectly via an ice-crystal and forms ice-crystal from a prescribed fraction of the supplied raw water by absorbing heat on said heat transfer surface while residual mother liquor is drained after said ice-crystal formation.

5. The soda drink selling machine according to claim 1 or 2, wherein the ice-crystal formed on the heat transfer surface of said heat pump is melted by releasing heat of said heat transfer surface after draining residual mother liquor to generate purified water.

6. The soda drink selling machine according to claim 1 or 2, wherein electronic heat pump is Peltier thermo-module comprising a module plate one surface of which serves as heat absorbing surface while the other surface of which serves as heat releasing surface and said heat absorbing surface and heat releasing surface are reversible by changing polarity of electric current.

7. The soda drink selling machine according to claim 1 or 2, wherein the coolant compression-evaporation type heat pump includes a coolant condenser and a heat exchanger connected to said coolant condenser in series.

8. The soda drink selling machine according to claim 1 or 2, having a raw-water fluidizing means in the ice maker to promote highly pure ice-crystal formation.

9. The soda drink selling machine according to claim 8, wherein the raw-water fluidizing means is an air bubbling device.

10. A soda drink selling machine in which an extensive range of quality of raw water is used, comprising:

a purified-water generating unit;

a soda drink producing/dispensing unit; and a control system for controlling each unit of the soda drink selling machine so as to be operated in a prescribed order or simultaneously;

wherein the soda drink producing-dispensing unit comprises a $CO_2$ gas dissolving means, a syrup mixing means and a soda drink dispensing means which are connected in this order; and wherein a constant temperature purified-water tank within said purified-water generating unit serves as $CO_2$ gas dissolving means.

11. A soda drink selling machine in which an extensive range of quality of raw water is used, comprising:

a purified-water generating unit;

a soda drink producing/dispensing unit; and a control system for controlling each unit of the soda drink selling machine so as to be operated in a prescribed order or simultaneously;

wherein the soda drink producing-dispensing unit comprises a $CO_2$ gas dissolving means, a syrup mixing means and a soda drink dispensing means which are connected in this order; and wherein an ice maker within said purified-water generating unit serves as $CO_2$ gas dissolving means.

* * * * *